US012389942B2

(12) United States Patent
Batista

(10) Patent No.: US 12,389,942 B2
(45) Date of Patent: Aug. 19, 2025

(54) AEROSOL-GENERATING DEVICE COMPRISING A CHAMBER FOR RECEIVING AN AEROSOL-GENERATING ARTICLE

(71) Applicant: PHILIP MORRIS PRODUCTS S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 599 days.

(21) Appl. No.: 17/778,495

(22) PCT Filed: Dec. 16, 2020

(86) PCT No.: PCT/EP2020/086366
§ 371 (c)(1),
(2) Date: May 20, 2022

(87) PCT Pub. No.: WO2021/122705
PCT Pub. Date: Jun. 24, 2021

(65) Prior Publication Data

US 2022/0408811 A1 Dec. 29, 2022

(30) Foreign Application Priority Data

Dec. 17, 2019 (EP) ..... 19216836

(51) Int. Cl.
*A24F 40/42* (2020.01)
*A24D 1/20* (2020.01)
*A24F 40/20* (2020.01)

(52) U.S. Cl.
CPC ..... *A24F 40/42* (2020.01); *A24D 1/20* (2020.01); *A24F 40/20* (2020.01)

(58) Field of Classification Search
CPC ..... A24F 40/42; A24F 40/20; A24F 40/40; A24F 40/465; A24D 1/20
See application file for complete search history.

(56) References Cited

U.S. PATENT DOCUMENTS 5,249,586 A * 10/1993 Morgan ..... A24F 40/46 131/194
5,443,560 A 8/1995 Deevi
(Continued)

FOREIGN PATENT DOCUMENTS

CN 208338885 U * 1/2019 ..... A24F 47/008
EP 3610741 2/2020
(Continued)

OTHER PUBLICATIONS

PCT Search Report and Written Opinion for PCT/EP2020/086366 dated Mar. 1, 2021 (15 pages).

*Primary Examiner* — Travis S Chambers
(74) *Attorney, Agent, or Firm* — Mueting Raasch Group

(57) ABSTRACT

An aerosol-generating device (100) for use with an aerosol-generating article comprises a chamber (121) for removably receiving at least a portion of the aerosol-generating article. Along a center axis (122) of the chamber (121), an inner surface (130) of the chamber (121) comprises a first axial portion (131) and a second axial portion (132), wherein the first axial portion (131) is closer to a proximal end (124) of the chamber (121) than the second axial portion (132). The second axial portion (132) is dimpled comprising a plurality of indentations (142), wherein the plurality of indentations (142) extend from a base level area of the second axial portion (142) outwards in a direction away from the center axis (122). The first axial portion (131) comprises a plurality of first protrusions (141), wherein the plurality of first protrusions (141) are configured to contact at a least a portion of the aerosol-generating article when the article is received
(Continued)

Figure 1:
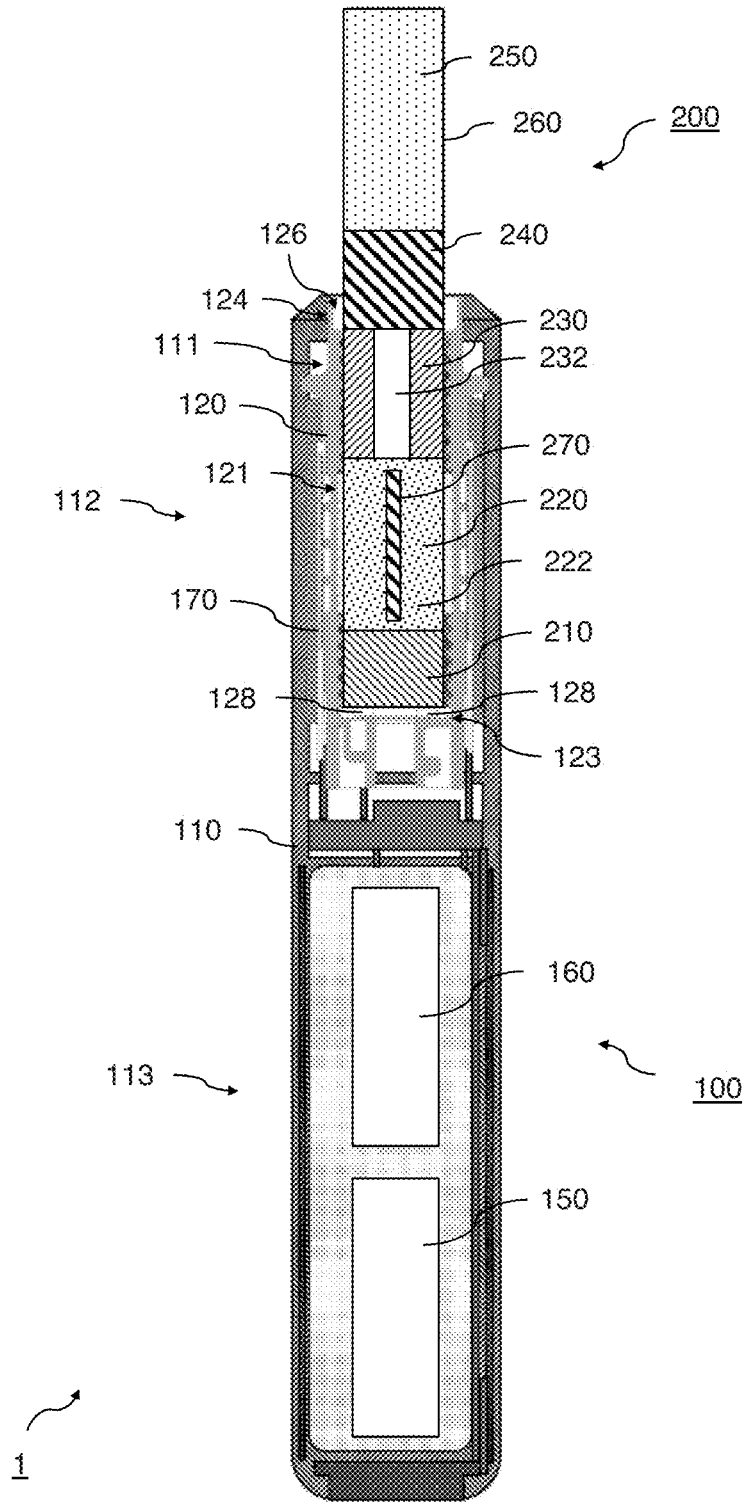

in the chamber (121), and wherein the plurality of first protrusions (141) extend from abase level area of the first axial portion (131) in a direction towards the center axis (122) beyond the base level area of the second axial portion (132).

20 Claims, 4 Drawing Sheets

(56) References Cited

U.S. PATENT DOCUMENTS

| | | | | |
|---|---|---|---|---|
| 11,197,497 | B2 * | 12/2021 | Lee | A24F 40/65 |
| 2017/0055580 | A1 | 3/2017 | Blandino | |
| 2019/0208820 | A1 | 7/2019 | Reevell | |
| 2019/0230989 | A1 | 8/2019 | Fursa | |
| 2022/0361574 | A1 * | 11/2022 | Reevell | A24F 40/46 |
| 2024/0016221 | A1 * | 1/2024 | Zhou | A24F 40/465 |
| 2024/0041112 | A1 * | 2/2024 | Sumii | A24F 40/42 |

FOREIGN PATENT DOCUMENTS

| | | |
|---|---|---|
| WO | WO 2018/190606 | 10/2018 |
| WO | WO 2020/216762 | 10/2020 |

* cited by examiner

AEROSOL-GENERATING DEVICE COMPRISING A CHAMBER FOR RECEIVING AN AEROSOL-GENERATING ARTICLE

This application is a U.S. National Stage Application of International Application No. PCT/EP2020/086366 filed Dec. 16, 2020, which was published in English on Jun. 24, 2021, as International Publication No. WO 2021/122705 A1. International Application No. PCT/EP2020/086366 claims priority to European Application No. 19216836.7 filed Dec. 17, 2019.

The present invention relates to an aerosol-generating device to be used with an aerosol-generating article for generating an inhalable aerosol by heating an aerosol-forming substrate comprised within the article. The invention further relates to an aerosol-generating system comprising such a device and such an article.

Aerosol-generating devices for generating an inhalable aerosol by heating an aerosol-forming substrate are generally known from prior art. Such devices may comprise a heating element, in particular a resistive heating element or an inductive heating element, for heating the aerosol-forming substrate within the device. The substrate itself may be integrally part of an aerosol-generating article which aerosol-generating article may be at least partially received in a chamber of the device. The chamber may be dimensioned to provide a relatively tight fit for the aerosol-generating article to hold the article in the chamber during use of the device. However, the tight fit may lead to undesired heat losses due to direct thermal conduction from the aerosol-generating article to the inner surface of the chamber. In addition, when the article is tightly received in the chamber, condensate formation within the chamber may cause an undesired moistening of the article, in particular of the substrate comprised therein. Such condensate formation may occur when vaporized compounds of the aerosol-forming substrate are cooled in contact with those portions of the chamber walls which are at temperatures below the dew point. Furthermore, a tight fit may restrict airflow through the chamber which in turn may affect the airflow management of the device and thus may cause a high resistance to draw (RTD). This applies in particular to devices where an airflow passage extends along the inner surface of the chamber, for example between the inner surface of the chamber and an outer surface of an aerosol-generating received in the chamber. A tight fit may also cause damages or even breakage of the aerosol-generating article when being inserted or extracted from the chamber. This may lead to debris in the chamber. Debris in the chamber may adversely affect a subsequent inhalation experience with another aerosol-generating article. Debris in the chamber would preferably need to be removed or cleaned, which creates more inconvenience for a user.

On the other hand, a sufficiently tight fit is necessary to prevent the article from being displaced or even falling out of the device during use. This applies all the more as many aerosol-forming substrates tend to shrink during use which may cause the retention of the article in the chamber to be reduced.

Therefore, it would be desirable to have an aerosol-generating device and an aerosol-generating system with the advantages of prior art solutions, whilst mitigating their limitations. In particular, there is need for an aerosol-generating device and a corresponding system providing an improved retention of an aerosol-generating article in the chamber of the device as well as an improved airflow management through the chamber.

According to an aspect of the present invention, there is provided an aerosol-generating device for use with an aerosol-generating article. The aerosol-generating device comprises a chamber. The chamber may be a chamber for removably receiving at least a portion of the aerosol-generating article. Along a center axis of the chamber, an inner surface of the chamber may comprise a first axial portion. The inner surface of the chamber may comprise a second axial portion. The first axial portion may be closer to a proximal end of the chamber than the second axial portion. The second axial portion may be dimpled. The second axial portion may be dimpled comprising a plurality of indentations. The plurality of indentations may extend from a base level area of the second axial portion outwards. The plurality of indentations may extend from a base level area of the second axial portion radially outwards, in a direction away from the center axis. The first axial portion may comprise a plurality of first protrusions. The plurality of first protrusions may be configured to contact at least a portion of an aerosol-generating article received in the chamber. The plurality of first protrusions may extend from a base level area of the first axial portion. The plurality of first protrusions may extend from a base level area of the first axial portion in a direction towards the center axis beyond the base level area of the second axial portion.

According to an aspect of the present invention, there is provided an aerosol-generating device for use with an aerosol-generating article. The aerosol-generating device comprises a chamber for removably receiving at least a portion of the aerosol-generating article. Along a center axis of the chamber, an inner surface of the chamber comprises a first axial portion and a second axial portion, wherein the first axial portion is closer to a proximal end of the chamber than the second axial portion. The second axial portion is dimpled comprising a plurality of indentations, wherein the plurality of indentations extend from a base level area of the second axial portion outwards, in particular radially outwards, in a direction away from the center axis. The first axial portion comprises a plurality of first protrusions, wherein the plurality of first protrusions are configured to contact at least a portion of the aerosol-generating article received in the chamber, and wherein the plurality of first protrusions extend from a base level area of the first axial portion in a direction towards the center axis beyond the base level area of the second axial portion.

In addition, the inner surface of the chamber may comprise a third axial portion along the center axis of the chamber. The third axial portion is closer to a distal end of the chamber than the second axial portion. The third axial portion comprises a plurality of second protrusions, wherein the plurality of second protrusions are configured to contact at least a portion of the aerosol-generating article received in the chamber. The plurality of second protrusions extend from a base level area of the third axial portion in a direction towards the center axis, beyond the base level area of the second axial portion. As will be described in more detail further below, the third axial portion may be provided in particular in case the article comprises a two support elements and a substrate element arranged between the two support elements.

Due to the plurality of first protrusions and the optional plurality of second protrusions extending in a direction towards the center axis beyond the base level area of the second axial portion, the aerosol-generating article is not in physical contact with the second axial portion at all when being received in the chamber. Accordingly, any direct thermal conduction from the aerosol-generating article to the second axial portion is avoided. Advantageously, this leads to a reduction of undesired heat losses and thus to an enhancement of the heating efficiency. Furthermore, as there is no direct physical contact between the second axial portion and those portions of the article which directly face the second axial portion when the article is received in the chamber, moistening of the article due to condensation is avoided at least in these portions.

Furthermore, it is to be understood that the aerosol-generating article is only in contact with the first protrusions of the first axial portion and—if present—with the second protrusions of the third axial portion. Accordingly, the contact surface between the article and the chamber is reduced as compared to a chamber having no protrusions. Therefore, conductive heat exchange between the aerosol-generating article and the surrounding chamber as well as moistening of the article are further reduced. Preferably, the plurality of first protrusions and the optional plurality of second protrusions comprise a contact surface for contacting the aerosol-generating article. The shape of the contact surface is adapted to the shape of the respective portion of the aerosol-generating article which the respective contact surface gets into contact with upon insertion of the article into the chamber. The contact surface may be curved or rounded in order to prevent the aerosol-generating article from damages.

In addition, the reduced contact surface area between the article and the chamber makes insertion and removal of the article easier, as the reduced contact surface area reduces the frictional forces to be overcome when moving an article into or out of the chamber.

Although not being in physical contact with the second axial portion, the aerosol-generating article is still securely retained in the chamber by the first protrusions of the first axial portion. If the third axial portion is present, the aerosol-generating article is even more securely retained. In particular, due to the local nature of the contact between the aerosol-generating article and the first protrusion and optional second protrusions, the retaining pressure between the article and the protrusions is locally enhanced such that the protrusion may form enlarged local depressions into the aerosol-generating article. Advantageously, the local depressions allow for compensating a possible shrinking of the article during use. Thus, the risk of the article to be displaced or to fall out of the aerosol-generating device advantageously is reduced.

The plurality of first protrusions and the optional plurality of second protrusions are distanced from each other such that an airflow passage is formed along the inner surface in between neighboring first protrusions and neighboring second protrusions, respectively.

With regard to this airflow passage along the inner surface, the dimpled second axial portion, in particular the plurality of indentations causes the airflow along the second axial portion to be turbulent. The effect of the dimpled second axial portion is the same effect as used to improve the aerodynamic behavior of golf balls. The plurality of indentations in the second axial portion generates a thin turbulent boundary layer of air that clings to the inner surface of the chamber. As compared to conventional aerosol-generating systems, the turbulent airflow helps to provide improved aerosol characteristics, for example, a better flavor profile, a better nicotine delivery profile over time, etc. Furthermore, the turbulent airflow advantageously ensures a sufficient heat exchange between air flowing around the article.

Likewise, the plurality of first protrusions and the optional plurality of second protrusions create a wide multi-dimensional matrix of airflow channels which also promote a turbulent airflow.

Preferably, there is an airflow passage extending along the inner surface of the chamber from a proximal end of the chamber towards a distal end of the chamber. With respect to this airflow passage, the first axial portion is upstream the second axial portion. Likewise, the optional third axial portion is downstream the second axial portion with respect to this airflow passage.

In general, the first axial portion and the optional third axial portion may be considered as surfaces comprising peaks and valleys, wherein the peaks correspond to the areas of the first and second protrusions which have the shortest distance to the center axis or are closest thereto, and wherein the valleys correspond to the areas between neighboring protrusions which include the base level area and have the largest distance to the center axis or are furthest away from the center axis. The first protrusions and the optional second protrusions are part of the first axial portion and the optional third axial portion, respectively, and, therefore, are part of the inner surface of the chamber.

Likewise, the second axial portion may be considered as a surface which comprises a plane corresponding to the base level area and a plurality of dimples in that plane. The indentations are part of the second axial portion and, therefore, are also part of the inner surface of the chamber.

In general, the number, the shape and the distance of the plurality of indentations may be chosen such as to ensure a turbulent airflow along the second axial portion.

Preferably, at least one indentation of the plurality of indentations, in particular each indentation of the plurality of indentations has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape. Any of these shapes is suitable to ensure a turbulent airflow along the second axial portion.

In particular, the indentations may be a substantially punctiform indentations. That is, the indentations may be substantially localized and singular indentations, wherein at depth dimension of the indentations is in the same order of magnitude as a width dimension of the indentation perpendicular to the depth dimension of the indentation. In some embodiments, the indentations may be interconnected. In some embodiments, the indentations may not be interconnected.

An opening area of at least one of the plurality of indentations in particular an opening area of each one of the plurality of indentations, may have a circular shape or an oval shape or an elliptical shape or a rectangular shape or a quadric shape or a rhombus shape or a parallelogram shape or triangular shape or a hexagonal shape or polygonal shape. Here, the opening area refers to the respective base of the above mentioned shapes. For example, in case of a pyramidal shape or a pimple-shape, the opening area corresponds to the base of the pyramid.

The formation of a turbulent airflow along the inner surface can be significantly influenced by the depth dimension of the indentations. Preferably, at least one indentation of the plurality of indentations, in particular each indentation of the plurality of indentations has a depth dimension in a direction normal to an opening area of the respective indentation in a range between 0.25 millimeter and 2 millimeter, in particular in a range between 0.5 millimeter and 1 millimeter. These values are particularly advantageous for an improved airflow management through the device. Preferably, all the indentations of the second axial portion have the same depth dimension.

The formation of a turbulent airflow can also be influenced by the density of the indentations. Preferably, a density of the plurality of indentations may be in a range between 0.1 and 1.0 indentations per square millimeter, preferably between 0.2 and 0.7 indentations per square millimeter. These values have also proven to be advantageous with regard to an improved airflow management through the device. As used herein, the density per square millimeter refers to an envelope surface tangent to each point of the base level area of the second axial portion. That is, the density per square millimeter is not referenced to the actual area content of the "dimpled" second axial portion, but to the area content of the projection of the second axial portion onto its base level area in direction normal to the base level area.

Likewise, the percentage of the base level area of the second axial portion relative to an envelope surface tangent to each point of the base level area of the second axial portion may be in a range between 2 percent and 50 percent, in particular between 10 percent and 40 percent.

Preferably, the plurality of indentations is arranged in a regular pattern. A regular pattern is particular suitable to promote a turbulent airflow. In addition, a regular pattern is easy to manufacture.

The base level area of the second axial portion may be a coherent area. That is, each section of the base level area is connected to any other section of the base level area either directly or indirectly through one or more other sections of the base level area. In other words, the base level area has no isolated sections.

Preferably, the base level area of the second axial portion has a hexagonal grid pattern. A hexagonal grid pattern allows for a very compact arrangement of the indentations and thus for a high density of the plurality of indentations. Alternatively, the base level area of the second axial portion may have a crisscross grid pattern.

The number, the shape and the distance of the plurality of first protrusions and the optional plurality of second protrusions may be chosen such as to contact a sufficient portion of the aerosol-generating article, in particular to securely retain the article in the chamber, and at the same time to allow for a sufficient airflow along the inner surface of the chamber, in particular between an outer surface of article and the inner surface of the chamber.

Preferably, at least one, in particular each one of the plurality of first protrusions has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape. Likewise, at least one, preferably each one of the optional plurality of second protrusions may have a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape. Any of these shapes proves beneficial to create a wide multi-dimensional matrix of airflow channels for promoting a turbulent airflow.

The first protrusions and the optional second protrusions may be a substantially punctiform projection, that is, a substantially localized in singular education, as in case of any one the aforementioned shapes. Advantageously, this leads to a punctiform contact between the protrusions and the aerosol-generating article. A punctiform contact is particularly beneficial with regard to a reduced moistening of the article and a reduced heat transfer from the aerosol-generating article to the surrounding chamber. In addition, for example as compared to a linear contact with ribs or even a complete contact with a smooth wall, a punctiform contact makes insertion and removal of the article easier, as the reduced contact surface area reduces the frictional forces to be overcome when moving an article into or out of the chamber. Furthermore, a punctiform shape of the first protrusions and the optional second protrusions particularly helps promoting an turbulent airflow in the region of the first and optional third axial portion due to the wide multi-dimensional matrix of airflow channels formed between the first protrusions and the optional second protrusions, Alternatively, the shape of the plurality of first protrusions and the optional plurality of second protrusions may be chosen such that there is a linear contact between the respective protrusions and the aerosol-generating article. In particular, at least one, preferably each one of the plurality of first protrusions may extend in a direction substantially along the center axis of the chamber. Likewise, at least one, preferably each one of the optional plurality of second protrusions may extend in a direction substantially along the center axis of the chamber.

A direction of extension substantially along the center axis may be parallel to the center axis, in particular in case of a substantially cylindrical chamber. Accordingly, at least one, preferably each one of the plurality of first protrusions may extend parallel to the center axis. Likewise, at least one, preferably each one of the optional plurality of second protrusions may extend parallel to the center axis.

A direction of extension of the respective protrusions substantially along the center axis may also be inclined with regard to the center axis (for example, by 2 degree to 5 degree), but still lying in a respective common plane with the center axis. The latter situation in particular applies to a substantially tapered, for example conical or frustoconical chamber. Hence in general, at least one, preferably each one of the plurality of first protrusions may extend along a respective plane containing the center axis. Likewise, at least one, preferably each one of the optional plurality of second protrusions may extend along a respective plane containing the center axis.

Advantageously, a direction of extension of the respective protrusions substantially along the center axis facilitates insertion and extraction of the aerosol-generating article into and from the chamber. This holds in particular in case the insertion direction corresponds to the direction of the center axis.

For example, at least one, in particular each of the plurality of first protrusions may comprise or may be formed as or may be a rib. Likewise, at least one, in particular each of the plurality of second protrusions may comprise or may be formed as or may be a rib. Preferably, the one or more ribs extend substantially along a direction of the center axis as described above, that is, parallel to the center or in the general direction of the center axis. The one or more ribs may have a substantially triangular cross-sectional shape. Alternatively, one or more ribs may have a substantially rectangular or substantially trapezoid or a substantially semi-oval or a substantially semi-circular cross-sectional shape.

At least one, in particular each of the plurality of first protrusions and/or at least one, in particular each of the plurality of second protrusions may be chamfered or may comprise at least one chamfer. Preferably, the respective protrusions may be chamfered at a side facing towards an insertion opening of the chamber or may comprise at least one chamfer facing towards an insertion opening of the chamber. Advantageously, this facilitates insertion of the article into the chamber. Likewise, the respective protrusions may be chamfered at a side facing away form an insertion opening of the chamber or may comprise at least one chamfer facing away from an insertion opening of the chamber. Advantageously, this facilitates removal of the article from the chamber.

As seen in the direction of the center axis, the plurality of first protrusions and the plurality of second protrusions may be arranged such that a positon of each first protrusion coincides with a positon of a respective second protrusion. In particular, the plurality of first protrusions and the plurality of second protrusions may be arranged such that each first protrusion superposes a respective second protrusion as seen in the direction of the center axis.

In general, the plurality of first protrusions and the optional plurality of second protrusions comprise least two first and second protrusions, respectively. In particular, the plurality of first protrusions and the optional plurality of second protrusions portion may comprise two, three, four, five, six, seven, eight, nine, ten, eleven, twelve or more first protrusions and second protrusions, respectively. In case the inner surface of the chamber only comprises a first and a second axial portion, but no third axial portion, it might be sufficient that the first axial portion comprises three protrusions which may be uniformly distributed along the inner circumference of the chamber. Likewise, in case the inner surface of the chamber also comprises third axial portion, each one of the first and a third axial portion may comprise two protrusions located opposite to each other, wherein the first protrusions the first axial portion are 90 degrees offset to the second protrusions of the third axial portion. Any of the aforementioned numbers provide a reasonable balance between a sufficiently large retention of the article and a sufficient reduction of the above described adverse effects. The numbers apply in particular for those protrusion shapes which provide a linear contact between the protrusions and the aerosol-generating article.

In case of the first and optional third protrusions have one of the above mentioned punctiform protrusion shapes, the number of protrusions may be larger. Accordingly, at least one of a density of the plurality of first protrusions and a density of the optional plurality of second protrusions may be in a range between 0.25 and 1.5 protrusions per square millimeter, in particular between 0.5 to 0.75 protrusions per square millimeter. Here, the density per square millimeter again refers to an envelope surface tangent to each point of the base level area of the first axial portion and the optional third axial portion, respectively. That is, the respective density per square millimeter is not referenced to the actual area content of the "uneven" first and third axial portion, but to the respective projection of the first and third axial portion normal to the respective base level area. The density of the plurality of first protrusions may be larger than, equal to or smaller than the density of the optional plurality of second protrusions. Likewise, at least one of the density of the plurality of first protrusions and the density of the plurality of second protrusions may be larger than, equal to or smaller than the density of the plurality of indentations of the second axial portion.

The height dimension of the first protrusions and the optional second protrusions defines the width of the airflow passage that is formed in between the first protrusions and the optional second protrusions, in particular between the outer surface of an article received in the chamber and the respective base level area of the first axial portion and the optional third axial portion. At least one, preferably each one of the plurality of first protrusions may have a height dimension in a range between 0.5 millimeter and 2 millimeter, in particular in a range of 0.75 millimeter and 1.5 millimeter. Likewise, at least one, preferably each one of the plurality of second protrusions has a height dimension in a range between 0.5 millimeter and 2 millimeter, in particular in a range of 0.75 millimeter and 1.5 millimeter. These height values have proven particularly advantageous for promoting an improved airflow management. Here, the height dimension of the first and optional second protrusions is defined as the distance between a peak of the respective protrusion and an adjacent part of the respective base level area as seen in a direction towards the center axis, preferably perpendicular to the center axis. Preferably, all the first protrusions have the same height dimension. Likewise, all the second protrusions—if present—may have the same height dimension.

The plurality of first protrusions or the optional plurality of second protrusions or both, the plurality of first protrusions and the optional plurality of second protrusions, may be arranged in a regular pattern. The plurality of first protrusions and the optional plurality of second protrusions, respectively, may be uniformly distributed along the inner circumference of the chamber. In particular, the plurality of first protrusions and the optional plurality of second protrusions, respectively, may be uniformly spaced apart from each other by respective valleys (interstices) arranged in between two neighboring protrusions. Advantageously, a regular pattern causes the retention of the aerosol-generating article to be uniform and thus particularly secure.

Like the base level area of the second axial portion, each one of base level area of the first axial portion and the base level area of the optional third axial portion is a coherent area. The base level area of the first axial portion and the base level area of the optional third axial portion have no isolated sections.

Preferably, at least one of the base level area of the first axial portion and the base level area of the optional third axial portion has a crisscross grid pattern. A crisscross pattern of the respective base level area provides linear airflow passages between the first and second protrusions.

Alternatively, at least one of the base level area of the first axial portion and the base level area of the optional third axial portion may have a hexagonal grid pattern.

Advantageously, the number, the shape and the distance of the plurality of first protrusions and the optional plurality of second protrusions, respectively, may be chosen such that upon inserting an aerosol-generating article in the chamber of the device a resistance to draw (RTD) is in a desired range. The resistance to draw may be in a range of 70 mmWG (millimeter water gauge) to 120 mmWG (millimeter water gauge). Preferably, the resistance to draw (RTD) may be between 40 mmWG (millimeter water gauge) and 70 mmWG (millimeter water gauge), in particular 45 mmWG (millimeter water gauge) and 65 mmWG (millimeter water gauge), for example 55 mmWG (millimeter water gauge).

The chamber may have a substantially cylindrical shape. As used herein, the term "substantially cylindrical shape" refers to a shape of the chamber when masking out the protrusions and indentations or without considering any protrusions and indentations. That is, the substantially cylindrical rod-shaped refers to the shape of the chamber as given by the respective base level area of the first, second and optional third axial portion. In case of a substantially cylindrical chamber, the plurality of first protrusions and the plurality of optional second protrusions extend beyond the second axial portion towards the center axis in a radial inward direction. In particular, any distances between the inner surface and the center axis are measured in a radial direction with regard to the center axis, that is, in a direction perpendicular to the center axis. Preferably, an envelope surface intersecting the peak of each protrusion of the plurality of first protrusions preferably also has a substantially cylindrical shape. Likewise, an envelope surface intersecting the peak of each indentations of the plurality of indentations may also have a substantially cylindrical shape. If present, an envelope surface intersecting the peak of each protrusion of the optional plurality of second protrusions preferably also has a substantially cylindrical shape.

Alternatively, the chamber may have a substantially tapered, in particular substantially conical or substantially frustoconical shape. As used herein, the term "substantially tapered, in particular substantially conical or substantially frustoconical shape" again refers to a shape of the chamber when masking out the protrusions and indentations or without considering any protrusions and indentations, that is, to the shape of the chamber as given by the respective base level area of the first, second and optional third axial portion. For any of these shapes, any distances between the inner surface and the center axis are preferably measured perpendicular to a surface of the substantially tapered, in particular substantially conical or substantially frustoconical shape, that is, normal to the respective base level area of the first, second and optional third axial portion. Preferably, an envelope surface intersecting the peak of each protrusion of the plurality of first protrusions also has a substantially tapered, in particular a substantially conical or a substantially frustoconical shape. Likewise, an envelope surface intersecting the peak of each indentations of the plurality of indentations may also have a substantially tapered, in particular substantially conical or substantially frustoconical shape. An envelope surface intersecting the peak of each protrusion of the optional plurality of second protrusions—if present—may also have a substantially tapered shape, in particular a substantially conical or substantially frustoconical shape.

Preferably, the chamber has a substantially circular cross-section as seen in a plane perpendicular to the center axis. In particular, the second axial portion may have a circular cross-section as seen in a plane perpendicular to the center axis. Likewise, at least one of the first axial portion and the optional third axial portion may have a substantially circular cross-section as seen in a plane perpendicular to the center axis, without considering the first protrusions or the second protrusions, respectively.

Alternatively, the chamber may also have a substantially elliptical cross-section or a substantially oval cross-section or a substantially square cross-section or a substantially rectangular cross-section or a substantially triangular cross-section or a substantially polygonal cross-section. As used herein, the above mentioned cross-sectional shapes preferably refer to a cross-sectional shape of the chamber without considering any protrusions.

Likewise, an envelope curve around the center axis which intersects the peak of each protrusion of the plurality of first protrusions or the optional plurality of second protrusions, respectively, may have one of a substantially circular or a substantially elliptical shape or a substantially oval shape or a substantially square shape or a substantially rectangular shape or a substantially triangular shape or a substantially polygonal shape. Preferably, the shape of an envelope curve around the center axis which intersects the peak of each protrusion of the plurality of first protrusions or the plurality of second protrusions, respectively, corresponds to the cross-sectional shape of the aerosol-generating article to be received in the chamber.

The chamber may comprise an insertion opening through which an aerosol-generating article may be inserted into the chamber. As used herein, the direction in which the aerosol-generating article is inserted is denoted as insertion direction. Preferably, the insertion direction corresponds to the extension of the center axis of the chamber. Upon insertion into the chamber, at least a portion of the aerosol-generating article may still extend outwards through the insertion opening. The outwardly extending portion preferably is provided for interaction with a user, in particular for being taken into a user's mouth. Hence, during use of the device, the insertion opening may be close to the user's mouth. Accordingly, the insertion opening may be arranged at a proximal end of the aerosol-generating device, in particular at the proximal end of the chamber.

Alternative, the chamber may be accessible laterally with regard to the center axis. That is, the aerosol-generating article may be inserted into the chamber laterally with regard to the center axis. In addition to the lateral access, the chamber may further comprise an opening through which at least a portion of the aerosol-generating article— upon being inserted into the chamber—may extend outwards, in particular in a direction corresponding to the direction of the center axis of the chamber. As an example, the aerosol-generating device may comprise a lateral insertion opening enabling to access the chamber laterally with regard to the center axis. The device may further comprise a lid for covering the lateral insertion opening of the chamber. The lid may be releasably attached to a main body of the aerosol-generating device. In particular, the lid may be hinged, that is, the lid may be attached to a main body of the aerosol-generating device by hinges. Likewise, the aerosol-generating device may comprise two housing portions, each forming a portion of the chamber. The two housing portions may be coupled to each other by hinges allowing the two housing portions to be transferred between an open position and a closed position, wherein the interior of the chamber is accessible in the open position.

In general, the length of the first axial portion, the length of the second axial portion and—if present—the length of the optional third axial portion may depend on the design of the aerosol-forming article to be received and retained in the chamber. As will be described in more detail below, the article may comprise different elements. In particular, in case the aerosol-generating article substantially has a rod shape, the article may comprise different elements sequentially arranged along a length axis of the article. Each portion of the inner surface of the chamber, that is, the first axial portion, the second axial portion and the optional third axial portion—if present—may be assigned to a specific element of the aerosol-forming article.

The second axial portion may have a length of at least 20 percent of an overall length of the inner surface or of the chamber in a direction of the center axis. Preferably, the second portion has a length of in a range between 20 percent and 40 percent, in particular between 25 percent and 40 percent, in particular between 30 percent and 35 percent of an overall length of the inner surface or of the chamber. Advantageously, such lengths provide a sufficient reduction of the above described adverse effects and in addition ensure that the airflow along the second axial portion is turbulent. The first axial portion and the optional third axial portion—if present—may have equal lengths in the direction of the center axis. Alternatively, the first axial portion and the third axial portion—if present—may have different lengths in the direction of the center axis.

The aerosol-generating device may comprise one or a plurality of end stops arranged within the chamber, in particular at a distal end of the chamber. The one or more end stops preferably are configured to limit an insertion depth of an aerosol-generating article into the chamber. In particular, the one or more end stops may be configured to prevent an aerosol-generating article from abutting the inner surface of the chamber at a distal end of the chamber that is opposite to an insertion opening of the chamber at a proximal end of the chamber. Thus, the one or more end stops advantageously provide free space within a distal portion of the chamber allowing free airflow between a distal end of the chamber and a distal end of an aerosol-generating article when the article is received in the chamber. The one or more end stops may comprise a contact surface which an aerosol-generating article, in particular a distal end of an aerosol-generating article may abut when the article is received in the chamber.

Preferably, the aerosol-generating device may comprise a plurality of separate end stops, for example three end stops, which are arranged within the chamber, in particular at a distal end of the chamber.

The plurality of end stops may be symmetrically arranged around the center axis. In particular, the plurality of end stops may be arranged equally spaced around the center axis. As described above, this enables free airflow around the end stops and an article received in the chamber.

The one or more ends stops preferably have a dimension in the direction of the center axis in a range between 0.5 millimeter and 5 millimeter, in particular in a range between 1 millimeter and 4 millimeter, preferably in a range between 1 millimeter and 2 millimeter, for example 1.4 millimeter.

The one or more ends stops preferably have a shape and dimension such as to extend in a direction towards the center axis beyond the plurality of first protrusions and the plurality of second protrusions. The one or more ends stops preferably have a radial extension perpendicular to the center axis in range between 0.7 millimeter and 6 millimeter, in particular in range between 1 millimeter and 5 millimeter, preferably in a range between 2 millimeter and 4 millimeter.

Preferably, the one or more end stops may have the shape of a ring-segment, in particular in case the chamber has a substantially cylindrical shape. The ring segment may have a height dimension in the direction of the center axis and a radial dimension perpendicular to the center axis. As mentioned before, the height dimension of a ring segment may be in a range of 0.5 millimeter to 5 millimeter, in particular in a range of 1 millimeter to 4 millimeter, preferably in a range of 1 millimeter to 2 millimeter. The radial dimension of a ring segment may be in range of 0.7 millimeter to 6 millimeter, in particular in range of 1 millimeter to 5 millimeter, preferably in a range of 1 millimeter to 3 millimeter, for example 1.3 millimeter.

As an example, the chamber may be formed as an elongate cavity comprising a bottom at a distal end of the chamber. In this configuration, the one or more end stops may be arranged within the chamber such as to protrude from the bottom at the distal end in a direction towards a proximal end of the chamber, in particular in a direction opposite to an insertion direction of the article.

The base level area of the first axial portion and the base level area of the second axial portion may be arranged on a common shell surface, in particular on a common cylindrical, conical or frustoconical shell surface. The base level area of the first axial portion and the base level area of the optional third axial portion may be arranged on a common shell surface, in particular on a common cylindrical, conical or frustoconical shell surface. The base level area of the second axial portion and the base level area of the optional third axial portion may be arranged on a common shell surface, in particular on a common cylindrical, conical or frustoconical shell surface. The base level area of the first axial portion, the base level area of the second axial portion and the base level area of the optional third axial portion may be arranged on a common shell surface, in particular on a common cylindrical, conical or frustoconical shell surface.

The chamber may be a multi-part component. In particular, the chamber may comprise a first part and a second part, wherein the second part preferably is inserted into the first part. The second part may be formed as a sleeve. The second part may be attached to the first part in a form-fit or positive-fit manner. Alternatively or additionally, the second part may be attached to the first part via a friction-fit or via a snap-fit. Preferably, the second part comprises the optional third axial portion—if present—, whereas the first part comprises the second axial portion and the first axial portion. Such a configuration facilitates manufacturing, in particular manufacturing by injection molding.

The chamber may be formed as a chamber module, in particular as a tubular sleeve, which may be inserted into a main body of the aerosol-generating device. Advantageously, this allows for a modular assembly of the aerosol-generating device.

Alternatively, at least a part of the chamber may be integrally formed with the main body. By providing at least a part of the chamber as a part of the main body, the quantity of used parts for the aerosol-generating device may be reduced.

The aerosol-generating device may further comprise a heating device for heating an aerosol-forming substrate within an aerosol-generating article received in the chamber of the device. The heating device may be an inductive heating device. The inductive heating device may comprise an induction source including an inductor which is configured to generate an alternating, in particular high-frequency magnetic field within the chamber. The alternating, in particular high-frequency magnetic field may be in the range between 500 kHz (kilo-Hertz) to 30 MHz (Mega-Hertz), in particular between 5 MHz (Mega-Hertz) to 15 MHz (Mega-Hertz), preferably between 5 MHz (Mega-Hertz) and 10 MHz (Mega-Hertz). Upon inserting an article into the chamber, the alternating magnetic field is used to inductively heat a susceptor which is in thermal contact with or thermal proximity to an aerosol-forming substrate to be heated. The inductor may be arranged such as to surround at least a portion of the chamber or at least a portion of the inner surface of the chamber, respectively. The inductor may be an inductor coil, for example a helical coil, arranged within a side wall of the chamber. Preferably, the inductor may be arranged such as to surround at least the second axial portion of the inner surface. More preferably, the inductor may be arranged such as to surround only the second portion of the inner surface. Alternatively, the inductor may be arranged such as to additionally surround at least partially the first axial portion or the third axial portion, or both, the first axial portion and the third axial portion.

Alternatively, the heating device may be a resistive heating device comprising a resistive heating element. The heating resistive element is configured to heat up when an electrical current is passed therethrough due to an immanent ohm resistance or resistive load of the resistive heating element. For example, the resistive heating element may comprise at least one of a resistive heating wire, a resistive heating track, a resistive heating grid or a resistive heating mesh. In use of the device, the resistive heating element is in thermal contact with or thermal proximity to an aerosol-forming substrate to be heated.

The aerosol-generating device may further comprise a controller configured to control operation of the device. In particular, the controller may be configured to control the heating device, preferably in a closed-loop configuration, for controlling heating of the aerosol-forming substrate to a pre-determined operating temperature. The operating temperature used for heating the aerosol-forming substrate may be at least 180 degree Celsius, in particular at least 300 degree Celsius, preferably at least 350 degree Celsius, more preferably at least 370 degree Celsius, most preferably at least 400 degree Celsius.

The aerosol-generating device may comprise a power supply, in particular a DC power supply configured to provide a DC supply voltage and a DC supply current to the inductive heating arrangement. Preferably, the power supply is a battery such as a lithium iron phosphate battery. As an alternative, the power supply may be another form of charge storage device such as a capacitor. The power supply may require recharging, that is, the power supply may be rechargeable. The power supply may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the heating device.

The aerosol-generating device may comprise a main body which preferably includes at least one of the controller and the power supply. In addition, the aerosol-generating device may comprise a chamber module received in a cavity of the main body or attached to the main body of the device. The chamber module comprises the chamber of the device at the present invention and as described herein.

The chamber module may be an independent subject matter of the present invention. Accordingly, the present invention further relates a chamber module for use in an aerosol-generating device, wherein the chamber module comprises a chamber for removably receiving at least a portion of the aerosol-generating article. Along a center axis of the chamber, an inner surface of the chamber comprises a first axial portion and a second axial portion. The first axial portion is closer to a proximal end of the chamber than the second axial portion. The second axial portion is dimpled comprising a plurality of indentations. The plurality of indentations extend from a base level area of the second axial portion outwards. The plurality of indentations may extend from a base level area of the second axial portion radially outwards, in a direction away from the center axis. The first axial portion comprises a plurality of first protrusions, wherein the plurality of first protrusions are configured to contact at least a portion of the aerosol-generating article received in the chamber. The plurality of first protrusions extend from a base level area of the first axial portion. The plurality of first protrusions may extend from a base level area of the first axial portion in a direction towards the center axis beyond the base level area of the second axial portion.

The chamber module may be configured to be received in a cavity of a main body of an aerosol-generating device or to be attachable to the main body of the device.

Further features of the chamber module, in particular of the chamber, have already been described above with regard to aerosol-generating device and equally apply.

The present invention further relates to an aerosol-generating system comprising an aerosol-generating device according to the invention and as described herein. The system further comprises an aerosol-generating article including at least one aerosol-forming substrate to be heated by the device, wherein at least a portion of the article is removably receivable or removably received in the chamber of the device.

The device and the article are configured such that upon insertion of the article in the chamber the plurality of first protrusions and—if present—the plurality of second protrusions contact at least a portion of the aerosol-generating article for retention of the aerosol-generating article in the chamber. In contrast, the second portion of the inner surface of the chamber is not in contact with the aerosol-generating article.

Preferably, the shape of an envelope curve around the center axis which intersects the peak of each protrusion of the plurality of first protrusions or the optional plurality of second protrusions, respectively, corresponds to the cross-sectional shape of the aerosol-generating article to be received in the chamber.

As described above with regard to the aerosol-generating device according to the present invention, the plurality of first protrusions and the optional plurality of second protrusions are distanced from each other such that airflow passages are formed in between neighboring first protrusions and—if present—between neighboring second protrusions, respectively. Advantageously, the shape and the distance of the plurality of first protrusions and the optional plurality of second protrusions, respectively, may be chosen such that upon inserting an aerosol-generating article in the chamber of the device a resistance to draw (RTD) is in a desired range. The resistance to draw may be in a range of 70 mmWG (millimeter water gauge) to 120 mmWG (millimeter water gauge). Preferably, the resistance to draw (RTD) may be between 40 mmWG (millimeter water gauge) and 70 mmWG (millimeter water gauge), in particular 45 mmWG (millimeter water gauge) and 65 mmWG (millimeter water gauge), for example 55 mmWG (millimeter water gauge).

As an example, the aerosol-generating article may comprise the following elements: a substrate element, a support element, a cooling element, and a filter element. All of the aforementioned elements may be sequentially arranged along a length axis of the article in the above described order, wherein the substrate element is arranged at a distal end of the article and the filter element is arranged at a proximal end of the article. In particular, the substrate element is located downstream the support element with regard to an airflow passing through the article in use of the system. Each of the aforementioned elements may be substantially cylindrical. In particular, all elements may have the same outer cross-sectional shape. In addition, the elements may be circumscribed by an outer wrapper such as to keep the elements together and to maintain the desired cross-sectional shape of the rod-shaped article. Preferably, the wrapper is made of paper.

The substrate element preferably comprise the at least one aerosol-forming substrate to be heated. In case the aerosol-generating system is based on induction heating, the substrate element may further comprise a susceptor which is in thermal contact with or thermal proximity to the aerosol-forming substrate.

The support element may comprise a hollow cellulose acetate tube having a free central air passage.

The aerosol-cooling element may be an element having a large surface area and a low resistance to draw, for example 15 mmWG (millimeter water gauge) to 20 mmWG (millimeter water gauge). In use, an aerosol formed by volatile compounds released from the substrate element is drawn through the aerosol-cooling element before being transported to the proximal end of the aerosol-generating article.

The filter element preferably serves as a mouthpiece, or as part of a mouthpiece together with the aerosol-cooling element. As used herein, the term "mouthpiece" refers to a portion of the article through which the aerosol exits the aerosol-generating article.

Where the aerosol-generating device is intended for use with an aerosol-generating article according to the specific example described before (only one support element), the chamber of the aerosol-generating device preferably comprises only a first axial portion and a second axial portion, but no third axial portion. In this configuration, the device and the article are preferably configured such that the support element is in contact with the first axial portion, and that the substrate element is surrounded by the second axial portion without being in contact with the second axial portion. However, the substrate element may be at least partially in contact with the first axial portion. Hence, the axial lengths of the first and second axial portion and the lengths of the support element and the substrate element of the article may be dimensioned such that at least a majority, in particular more than 50% of the substrate element, but preferably all of the substrate element is aligned with the second axial portion when the aerosol generating article is received within the chamber. As used herein, the term "in contact with" is to be understood such that the support element or parts of the substrate elements is in indirect or in direct contact with the axial portion, depending on whether the support element and the substrate element are surrounded by a wrapper or not.

Preferably, the support element may have a length in a direction along a length axis of the rod-shaped article which corresponds to a length of the first axial portion along the center axis of the chamber. Likewise, the substrate element may have a length in a direction along a length axis of the rod-shaped article which corresponds to a length of the second axial portion along the center axis of the chamber. Alternatively, the first axial portion may have a length which is larger than a length of the support element such as to get at least partially into touch with the substrate element.

According to another example, the aerosol-generating article may comprise the following elements: a distal support element, a substrate element, a proximal support element, a cooling element, and a filter element. All of the aforementioned elements may be sequentially arranged along a length axis of the article in the above described order, wherein the distal support element is arranged at a distal end of the article and the filter element is arranged at a proximal end of the article. That is, the substrate element is located between the proximal support element and the distal support element. In particular, the substrate element is located downstream the proximal support element and upstream the distal support element with regard to an airflow passing through the article in use of the system. Each of the aforementioned elements may be substantially cylindrical. In particular, all elements may have the same outer cross-sectional shape. In addition, the elements may be circumscribed by an outer wrapper such as to keep the elements together and to maintain the desired cross-sectional shape of the rod-shaped article. Preferably, the wrapper is made of paper.

The substrate, the cooling element and the filter element may correspond to the respective elements according to the aforementioned example.

The distal and the proximal support element may comprise a hollow cellulose acetate tube having a free central air passage. Alternatively, the distal support element may comprise a cellulose acetate plug (without a free central air passage). The cellulose acetate plug may be used to cover and protect the distal front end of the substrate element.

Where the aerosol-generating device is intended for use with an aerosol-generating article according to the specific example described before (two support elements), the chamber of the aerosol-generating device preferably comprises a first axial portion, a second axial portion and a third axial portion as described above. In this configuration, the device and the article are preferably configured such that the proximal support element is in contact with the first axial portion, the distal support element is in contact with the third axial portion and the substrate element is surrounded by the second axial portion without being in contact with the second axial portion. However, the substrate element may be at least partially in contact with the at least one of the first axial portion or the third axial portion. Hence, the axial lengths of the first, second and third axial portion and the lengths of the proximal support element, the substrate element and the distal support element of the article may be dimensioned such that at least a majority, in particular more than 50% of the substrate element, but preferably all of the substrate element is aligned with the second axial portion when the aerosol generating article is received within the chamber.

Preferably, the proximal support element may have a length in a direction along a length axis of the rod-shaped article which corresponds to a length of the first axial portion along the center axis of the chamber. Likewise, the distal support element may have a length in a direction along a length axis of the rod-shaped article which corresponds to a length of the third axial portion along the center axis of the chamber. Accordingly, the substrate element may have a length in a direction along a length axis of the rod-shaped article which corresponds to a length of the second axial portion along the center axis of the chamber. Alternatively, at least one of the first axial portion and the second axial portion may have a length which is larger than a length of the proximal support element or the distal support element, respectively, such as to get at least partially into touch with the substrate element.

Any of the aforementioned configurations is advantageous for several reasons: First, the substrate element is spaced apart from the second axial portion and thus less affected by condensate formation. Furthermore, the first and optional second protrusions of the first and the third axial portion advantageously engage with those portions of the article which are most rigid and which tend to shrink least during use. Due to this, the article is securely retained within the chamber without the risk to be displaced or to fall out of the device.

Further features and advantages of the aerosol-generating system and the aerosol-generating article according to the present invention have already been described above with regard to aerosol-generating device and equally apply.

As used herein, the term "aerosol-generating device" generally refers to an electrically operated device that is capable of interacting with an aerosol-forming substrate provided within an aerosol-generating article, such as to generate an aerosol by heating the substrate. Preferably, the aerosol-generating device is a puffing device for generating an aerosol that is directly inhalable by a user thorough the user's mouth. In particular, the aerosol-generating device is a hand-held aerosol-generating device.

As used herein, the term "aerosol-generating article" refers to an article comprising at least one aerosol-forming substrate that, when heated, releases volatile compounds that can form an aerosol. Preferably, the aerosol-generating article is a heated aerosol-generating article. That is, an aerosol-generating article which comprises at least one aerosol-forming substrate that is intended to be heated rather than combusted in order to release volatile compounds that can form an aerosol. The aerosol-generating article may be a consumable, in particular a consumable to be discarded after a single use. For example, the article may be a cartridge including a liquid aerosol-forming substrate to be heated. Alternatively, the article may be a rod-shaped article, in particular a tobacco article, resembling conventional cigarettes. As stated above, the article may further comprise a susceptor positioned in thermal proximity to or thermal contact with the aerosol-forming substrate such that in use the susceptor is inductively heatable by the inductive heating arrangement when the article is received in the cavity of the device.

As used herein, the term "susceptor" refers to an element that is capable to convert electromagnetic energy into heat when subjected to an alternating magnetic field. This may be the result of hysteresis losses and/or eddy currents induced in the susceptor, depending on the electrical and magnetic properties of the susceptor material. Hysteresis losses occur in ferromagnetic or ferrimagnetic susceptors due to magnetic domains within the material being switched under the influence of an alternating electromagnetic field. Eddy currents may be induced if the susceptor is electrically conductive. In case of an electrically conductive ferromagnetic or ferrimagnetic susceptor, heat can be generated due to both, eddy currents and hysteresis losses.

As used herein, the term "aerosol-forming substrate" denotes a substrate formed from or comprising an aerosol-forming material that is capable of releasing volatile compounds upon heating for generating an aerosol. The aerosol-forming substrate is intended to be heated rather than combusted in order to release the aerosol-forming volatile compounds. The aerosol-forming substrate may be a solid aerosol-forming substrate or a liquid aerosol-forming substrate or a gel-like aerosol-forming substrate, or any combination thereof. That is, the aerosol-forming substrate may comprise, for example, both solid and liquid components. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerin and propylene glycol. The aerosol-forming substrate may also comprise other additives and ingredients, such as nicotine or flavorings. The aerosol-forming substrate may also be a paste-like material, a sachet of porous material comprising aerosol-forming substrate, or, for example, loose tobacco mixed with a gelling agent or sticky agent, which could include a common aerosol former such as glycerin, and which is compressed or molded into a plug.

As used herein, the term "aerosol-generating system" refers to the combination of an aerosol-generating article as further described herein with an aerosol-generating device according to the invention and as described herein. In the system, the article and the device cooperate to generate a respirable aerosol.

As used herein, sections close to a user's mouth in use of the device, in particular close to an insertion opening of the chamber—if present—are denoted with the prefix "proximal". Sections which are arranged further away are denoted with the prefix "distal". Accordingly, the chamber may be arranged or located in a proximal portion of the aerosol-generating device. Likewise, the insertion opening—if present—may be arranged or located at a proximal end of the aerosol-generating device.

As used herein, the term "extending in a direction towards the center axis" means that the plurality of first protrusions and the optional plurality of second protrusions extend into the interior of the chamber. Depending on the general shape of the chamber, the direction towards the center axis may be in particular perpendicular to the center axis. In particular, "extending beyond the base level area of the second axial portion of the inner surface in a direction towards the center axis" means that in a direction towards the center axis each protrusion of the plurality of first protrusions and each protrusion of the optional plurality of second protrusions extends beyond a corresponding part of the base level area of the second axial portion having the same azimuthal position with regard to the center axis of the chamber. That is, at a given azimuthal position of a respective first or optional second protrusion, the base level area of the second portion is outwardly recessed relative that respective first or optional second protrusion as seen in an outward direction extending away from the center axis.

As used herein, the term "configured to contact at least a portion of the aerosol-generating article" is to be understood such that at least a part of the protrusions of the plurality of first protrusions, in particular 70 percent or more, preferably 80 percent or more, more preferably 90 percent or more of the plurality of first protrusions is in contact with the aerosol-generating article, when the aerosol-generating article is received in the chamber. The same applies for the optional plurality of second protrusions. That is , e term "configured to contact at least a portion of the aerosol-generating article" is to be understood such that at least a part of the protrusions of the plurality of second protrusions, in particular 70 percent or more, preferably 80 percent or more, more preferably 90 percent or more of the plurality of second protrusions is in contact with the aerosol-generating article, when the aerosol-generating article is received in the chamber.

As used herein, the term "base level area" of the first axial portion, the second axial portion and the optional third axial portion refers to those areas of the first axial portion, the second axial portion and the optional third axial portion which do not comprise indentations or protrusions. That is, the base level area refers to those areas of the first axial portion, the second axial portion and the optional third axial portion which remain when masking out the plurality of indentations or protrusions or without considering the plurality of indentations or protrusions.

Below, there is provided a non-exhaustive list of non-limiting examples. Any one or more of the features of these examples may be combined with any one or more features of another example, embodiment, or aspect described herein.

Example 1: Aerosol-generating device for use with an aerosol-generating article, the aerosol-generating device comprising a chamber for removably receiving at least a portion of the aerosol-generating article, wherein along a center axis of the chamber, an inner surface of the chamber comprises a first axial portion and a second axial portion, wherein the first axial portion is closer to a proximal end of the chamber than the second axial portion, wherein the second axial portion is dimpled comprising a plurality of indentations, wherein the plurality of indentations extend from a base level area of the second axial portion outwards, in particular radially outwards, in a direction away from the center axis, and wherein the first axial portion comprises a plurality of first protrusions, wherein the plurality of first protrusions are configured to contact at least a portion of the aerosol-generating article received in the chamber, and wherein the plurality of first protrusions extend from a base level area of the first axial portion in a direction towards the center axis beyond the base level area of the second axial portion.

Example 2: Aerosol-generating device according to example 1, wherein, along the center axis of the chamber, the inner surface of the chamber comprises a third axial portion, the third axial portion being closer to a distal end of the chamber than the second axial portion, wherein the third axial portion comprises a plurality of second protrusions, wherein the plurality of second protrusions are configured to contact at least a portion of the aerosol-generating article received in the chamber, wherein the plurality of second protrusions extend from a base level area of the third axial portion in a direction towards the center axis, beyond the base level area of the second axial portion.

Example 3: Aerosol-generating device according to any one of the preceding examples, wherein at least one of the plurality of indentations, in particular each one of the plurality of indentations, has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape.

Example 4: Aerosol-generating device according to any of the preceding examples, wherein an opening area of at least one of the plurality of indentations, in particular an opening area of each one of the plurality of indentations, has a circular shape or an oval shape or an elliptical shape or a rectangular shape or a quadric shape or a rhombus shape or a parallelogram shape or triangular shape or a hexagonal shape or polygonal shape.

Example 5: Aerosol-generating device according to any one of the preceding examples, wherein a density of the plurality of indentations is in a range between 0.1 and 1.0 indentations per square millimeter, preferably between 0.2 and 0.7 indentations per square millimeter.

Example 6: Aerosol-generating device according to any of the preceding examples, wherein at least one of the plurality of indentations has a depth dimension in a direction normal to an opening area of the respective indentation in a range between 0.25 millimeter and 2 millimeter, preferably in a range between 0.5 millimeter and 1 millimeter.

Example 7: Aerosol-generating device according to any one of the preceding examples, wherein the plurality of indentations is arranged in a regular pattern.

Example 8: Aerosol-generating device according to any one of the preceding examples, wherein the second axial portion is a coherent area.

Example 9: Aerosol-generating device according to any one of the preceding examples, wherein the base level area of the second axial portion has a hexagonal grid pattern.

Example 10: Aerosol-generating device according to any one of the preceding examples, wherein the second axial portion has a crisscross grid pattern.

Example 11: Aerosol-generating device according to any one of the preceding examples, wherein the second axial portion has a length of at least 20 percent of an overall length of the inner surface or the chamber in the direction of the center axis, in particular in a range between 20 percent and 40 percent or between 25 percent and 40 percent or between 30 percent and 35 percent of an overall length of the inner surface or of the chamber.

Example 12: Aerosol-generating device according to any one of the preceding examples, wherein at least one, preferably each one of the plurality of first protrusions has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape.

Example 13: Aerosol-generating device according to any one of the preceding examples, wherein at least one, preferably each one of the optional plurality of second protrusions has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape.

Example 14: Aerosol-generating device according to any one of the preceding examples, wherein the first protrusions and the optional second protrusions may be substantially punctiform projections.

Example 15: Aerosol-generating device according to any one of the preceding examples, wherein at least one of a density of the plurality of first protrusions and a density of the optional plurality of second protrusions is in a range between 0.25 and 1.5 protrusions per square millimeter, in particular between 0.5 to 0.75 protrusions per square millimeter.

Example 16: Aerosol-generating device according to any one of the preceding examples, wherein at least one, preferably each one of the plurality of first protrusions has a height dimension in a range between 0.5 millimeter and 2 millimeter, in particular in a range of 0.75 millimeter and 1.5 millimeter.

Example 17: Aerosol-generating device according to any one of the preceding examples, wherein at least one, preferably each one of the plurality of second protrusions has a height dimension in a range between 0.5 millimeter and 2 millimeter, in particular in a range of 0.75 millimeter and 1.5 millimeter.

Example 18: Aerosol-generating device according to any one of the preceding examples, wherein the plurality of first protrusions is arranged in a regular pattern.

Example 19: Aerosol-generating device according to any one of the preceding examples, wherein the plurality of second protrusions is arranged in a regular pattern.

Example 20: Aerosol-generating device according to any one of the preceding examples, wherein at least one of the base level area of the first axial portion and the base level area of the optional third axial portion is a coherent area.

Example 21: Aerosol-generating device according to any one of the preceding examples, wherein least one of the base level area of the first axial portion and the base level area of the optional third axial portion has a crisscross grid pattern.

Example 22: Aerosol-generating device according to any one of the preceding examples, wherein the chamber has a substantially cylindrical shape or a substantially tapered, in particular substantially conical or substantially frustoconical shape.

Example 23: Aerosol-generating device according to any one of the preceding examples, wherein the chamber has a substantially circular cross-section or a substantially elliptical cross-section or a substantially oval cross-section or a substantially square cross-section or a substantially rectangular cross-section or a substantially triangular cross-section or a substantially polygonal cross-section as seen in a plane perpendicular to the center axis.

Example 24: Aerosol-generating device according to any one of the preceding examples, wherein the chamber comprises an insertion opening for inserting an aerosol-generating article into the chamber.

Example 25: Aerosol-generating device according to example 24, wherein the insertion opening is located at a proximal end of the aerosol-generating device, in particular at the proximal end of the chamber.

Example 26: Aerosol-generating device according to any one of the preceding examples, wherein the device comprises one or a plurality of end stops arranged within the chamber, in particular at a distal end of the chamber.

Example 27: Aerosol-generating device according to example 26, wherein the plurality of end stops are symmetrically arranged around the center axis, in particular equally spaced around the center axis.

Example 28: Aerosol-generating device according to any one of example 26 or 27, wherein the one or the plurality of end stops have a dimension in the direction of the center axis in a range between 0.5 millimeter and 5 millimeter, in particular in a range between 1 millimeter and 4 millimeter, preferably in a range between 1 millimeter and 2 millimeter, for example 1.4 millimeter.

Example 29: Aerosol-generating device according to any one of examples 26 to 28, wherein the one or the plurality of end stops have a radial extension perpendicular to the center axis in range between 0.7 millimeter and 6 millimeter, in particular in range between 1 millimeter and 5 millimeter, preferably in a range between 2 millimeter and 4 millimeter.

Example 30: Aerosol-generating device according to any one of examples 26 to 29, wherein the one or the plurality of end stops have the shape of a ring-segment.

Example 31: Aerosol-generating device according to any one of the preceding examples, wherein the base level area of the first axial portion and the base level area of the second axial portion is arranged on a common shell surface, in particular on a common cylindrical, conical or frustoconical shell surface.

Example 32: Aerosol-generating device according to any one of the preceding examples, wherein the base level area of the first axial portion and the base level area of the optional third axial portion is arranged on a common shell surface, in particular on a common cylindrical, conical or frustoconical shell surface.

Example 33: Aerosol-generating device according to any one of the preceding examples, wherein the base level area of the second axial portion and the base level area of the optional third axial portion is arranged on a common shell surface, in particular on a common cylindrical, conical or frustoconical shell surface.

Example 34: Aerosol-generating device according to any one of the preceding examples, wherein the base level area of the first axial portion, the base level area of the second axial portion and the base level area of the optional third axial portion is arranged on a common shell surface, in particular on a common cylindrical, conical or frustoconical shell surface.

Example 35: Aerosol-generating device according to any one of the preceding examples, wherein the device may comprises a main body and a chamber module received in a cavity of the main body or attached to the main body, wherein the chamber module comprises the chamber.

Example 36: Chamber module for use in an aerosol-generating device, wherein the chamber module comprises a chamber for removably receiving at least a portion of the aerosol-generating article, wherein along a center axis of the chamber, an inner surface of the chamber comprises a first axial portion and a second axial portion, wherein the first axial portion is closer to a proximal end of the chamber than the second axial portion, wherein the second axial portion is dimpled comprising a plurality of indentations, wherein the plurality of indentations extend from a base level area of the second axial portion outwards, in particular radially outwards, in a direction away from the center axis, and wherein the first axial portion comprises a plurality of first protrusions, wherein the plurality of first protrusions are configured to contact at least a portion of the aerosol-generating article received in the chamber, and wherein the plurality of first protrusions extend from a base level area of the first axial portion in a direction towards the center axis beyond the base level area of the second axial portion.

Example 37: Chamber module according to example 36, wherein the chamber module is configured to be received in a cavity of a main body of an aerosol-generating device or to be attachable to a main body of an aerosol-generating device.

Example 38: Aerosol-generating system comprising an aerosol-generating device according to any one of the preceding examples and an aerosol-generating article comprising an aerosol-forming substrate, wherein at least a portion of the aerosol-generating article is removably received or removably receivable in the chamber of the aerosol-generating device.

Example 39: Aerosol-generating system according to example, wherein the aerosol-generating article comprises at least a proximal support element, and optional distal support element and a substrate element comprising the aerosol-forming substrate, the substrate element being located downstream the proximal support element and upstream the optional distal support element with regard to an airflow passing through the article in use of the system, wherein upon receiving the article in the chamber the proximal support element is in contact with the first axial portion, the optional third axial portion is in contact with the optional distal support element, and the substrate element is surrounded by the second axial portion without being in contact with the second axial portion.

Figure 2:
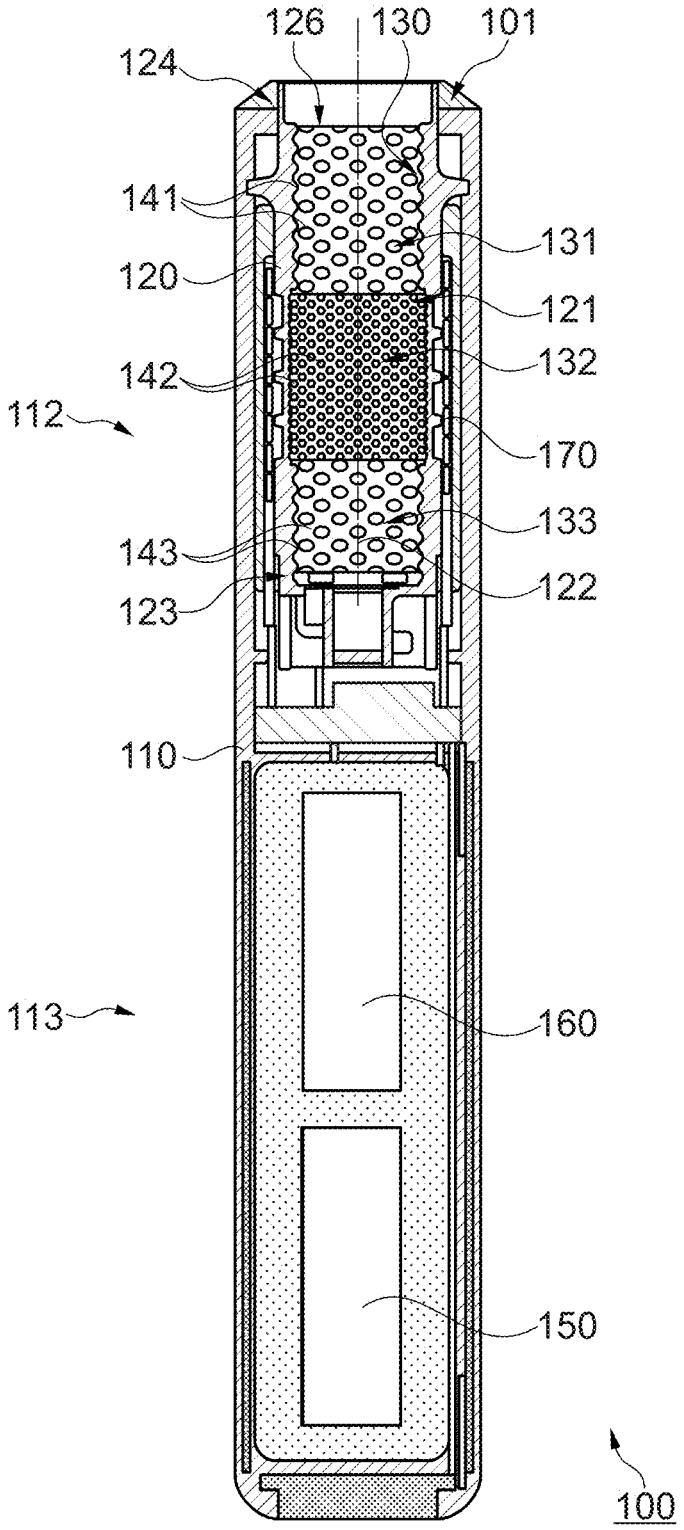
Figure 3:
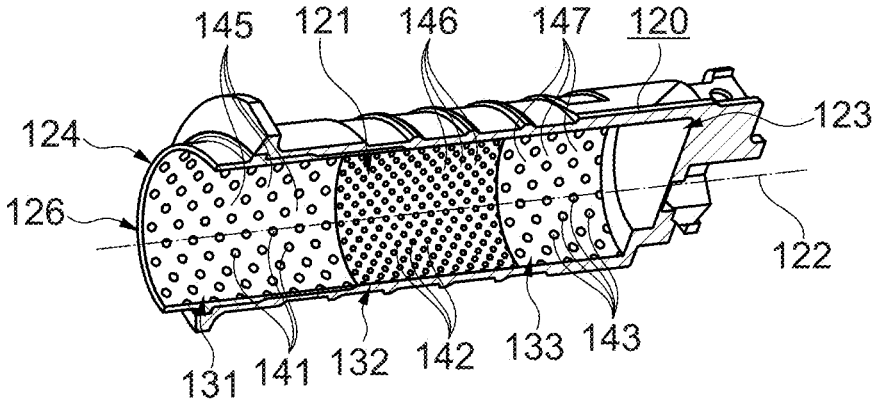
Figure 4:
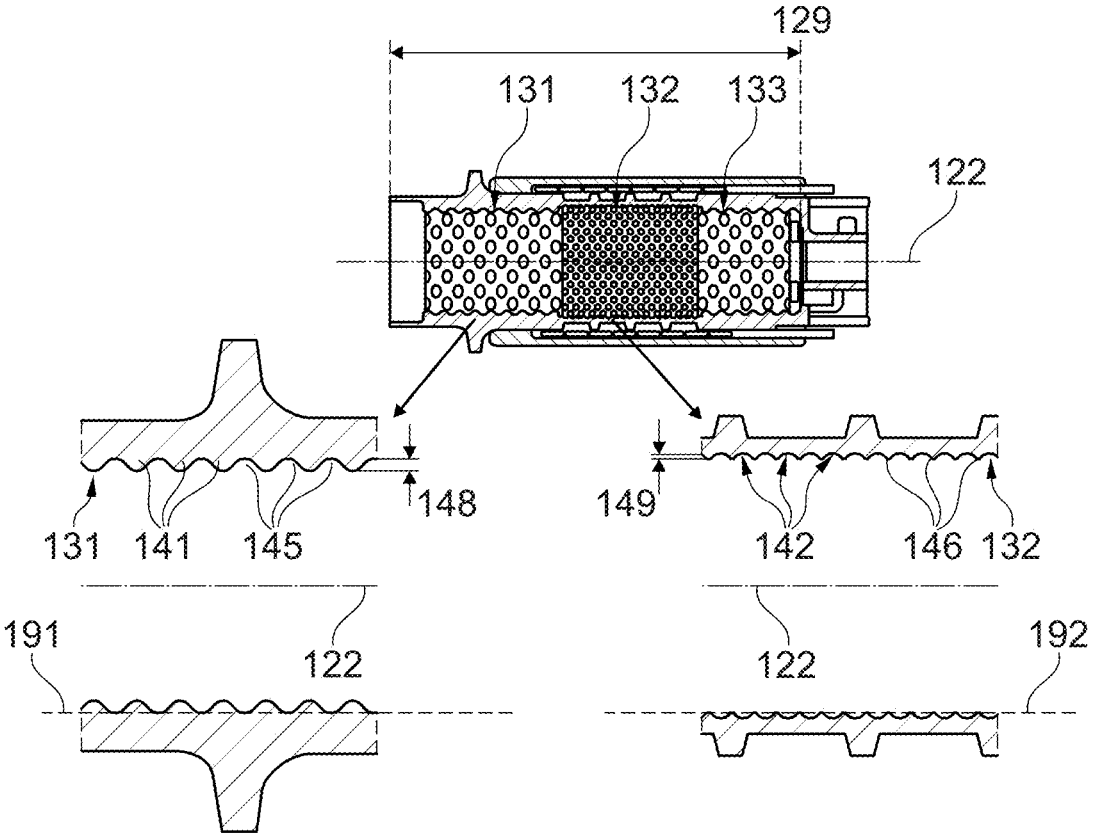
Figure 5:
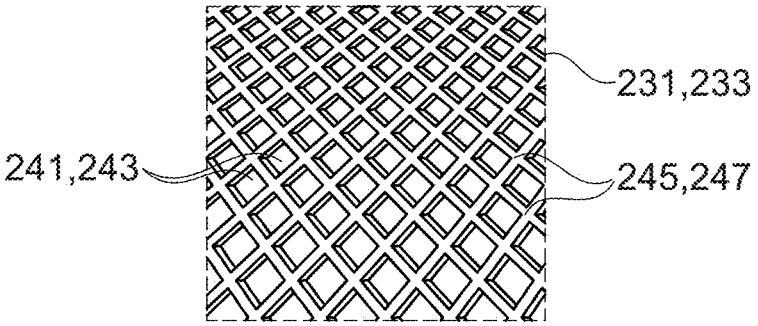
Figure 6:
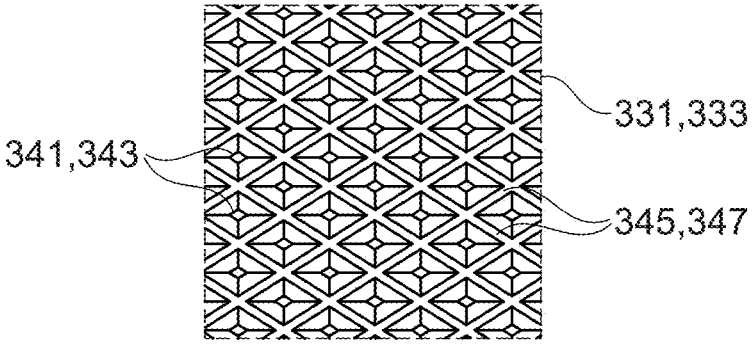
Figure 7:
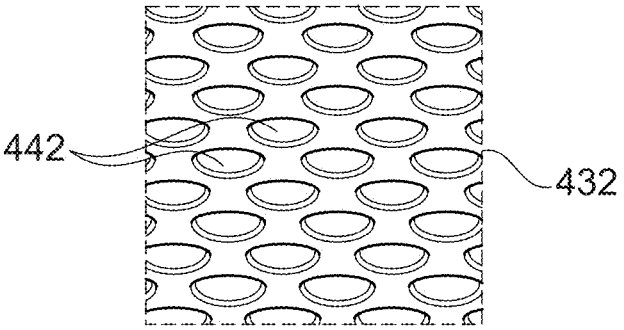

Examples will now be further described with reference to the figures in which:

FIG. 1 schematically illustrates in a sectional view an exemplary embodiment of an aerosol-generating system according to the present invention comprising aerosol-generating device and an aerosol-generating article;

FIG. 2 schematically illustrates the aerosol-generating system according to FIG. 1 without the article;

FIG. 3 schematically illustrates a chamber module of the device according to FIG. 1 in a perspective view;

FIG. 4 schematically illustrates the chamber module according to FIG. 3 in a sectional view; and FIG. 5-7 schematically illustrate different embodiments of, respectively, the first, second and third axial portion of the inner surface of the chamber of the device according to FIG. 1.

FIG. 1 and FIG. 2 schematically illustrate an exemplary embodiment of an aerosol-generating system 1 according to the present invention. The system 1 comprises two main components: an aerosol-generating article 200 and an aerosol-generating device 100 for use with the article 200 in order to generate an inhalable aerosol by heating an aerosol-forming substrate 222 comprised within the article 200.

The aerosol-generating device 100 has an elongated shape and comprises a main body 110 and a sleeve-shaped chamber module 120. The chamber module 120 comprises a chamber 121 for receiving at least a portion of the aerosol-generating article 200. The chamber module 120 is inserted into a cavity 111 formed within a proximal portion 112 of the main body 110. Within a distal portion 113, the main body 110 comprises a power source 150 and a controller 160 for powering and controlling operation of the device 100.

The article 200 has a rod shape resembling the shape of a conventional cigarette. In the present embodiment, the article 200 comprises five elements arranged in coaxial alignment: a distal support element 210, a substrate element 220, a proximal support element 230, an aerosol-cooling element 240, and a filter plug 250. The distal support element 210 is arranged at a distal end of the article 200. The substrate element 220 comprises the aerosol-forming substrate 222 to be heated. The aerosol-forming substrate 22 may include, for example, a crimped sheet of homogenized tobacco material including glycerin as an aerosol-former. The proximal support element 230 comprises a hollow core forming a central air passage 232. The filter plug 250 serves as a mouthpiece and may include, for example, cellulose acetate fibers. The five elements are substantially cylindrical elements being arranged sequentially one after the other. The elements have substantially the same diameter and are circumscribed by an outer wrapper 260 made of cigarette paper such as to form a cylindrical rod. The outer wrapper 260 may be wrapped around the aforementioned elements so that free ends of the wrapper overlap each other. The wrapper may further comprise adhesive that adheres the overlapped free ends of the wrapper to each other.

For heating the substrate 222 within the article 200, the aerosol-generating device 100 according to the present invention comprises an inductive heating device. The inductive heating device comprises an induction coil 170 for generating an alternating, in particular high-frequency magnetic field within the chamber 121. Preferably, the high-frequency magnetic field may be in the range between 500 kHz (kilo-Hertz) to 30 MHz (Mega-Hertz), in particular between 5 MHz (Mega-Hertz) to 15 MHz (Mega-Hertz), preferably between 5 MHz (Mega-Hertz) and 10 MHz (Mega-Hertz). In the present embodiment, the induction coil 170 is a helical coil circumferentially surrounding the cylindrical chamber module 120 along its length axis 122. The alternating magnetic field is used for in inductively heating a susceptor 270 that is arranged within the aerosol-forming substrate 222 of the article 200 such as to experience the magnetic field generated by the induction coil 170 when the article 200 is received in the chamber 121. In the present embodiment, the susceptor 270 is a susceptor blade that is arranged within the substrate element 220 along the length axis of the article 200 such as to be in direct physical contact with aerosol-forming substrate 222.

Accordingly, when the inductive heating device is actuated, a high-frequency alternating current is passed through the induction coil 170 causing the alternating magnetic field to be generated within the chamber 121. Depending on the magnetic and electric properties of the respective susceptor material, the alternating magnetic field induces at least one of eddy currents or hysteresis losses in the susceptor 270. As a consequence, the susceptor 270 is heated up until reaching a temperature that is sufficient to form an aerosol from the substrate 222. The generated aerosol may be drawn downstream through the aerosol-generating article 200 for inhalation by the user.

FIG. 3 and FIG. 4 illustrate further details of the chamber module 120 and the chamber 121 which is defined by the walls of the chamber module 120. The chamber module 120 is an elongated sleeve comprising an insertion opening 126 through which the aerosol-generating article 200 may be inserted into the chamber 121 at the proximal end 101 of the device 100. The insertion direction of the aerosol-generating article 200 substantially extends along a center axis 122 of the chamber 121. The chamber module 120 is made of PEEK (polyether ether ketone). In the present embodiment, the chamber 121 has a substantially cylindrical shape with a substantially circular cross-section having a diameter of about 15 millimeter. The cylindrical shape and the circular cross-section of the chamber 121 substantially correspond to the cylindrical shape and the circular cross-section of the aerosol-generating article 200.

The chamber 121 comprises an inner surface 130 which extends over the entire axial length of the chamber 121. In the present embodiment, the axial length of the chamber 121 is in range of 25 millimeter to 28 millimeter. Along the center axis 122 of the chamber 121, the inner surface 130 comprises a first axial portion 131, a second axial 132 portion and a third axial portion 133, wherein the first axial portion 131 is closer to a proximal end 124 of the chamber 121 than the second axial portion 132 and the third axial portion 133 is closer to a distal end 123 of the chamber 121 than the second axial portion 132. Accordingly, the second axial portion 132 is located between the first axial portion 131 and the third axial portion 133. The length of the second axial portion 132 is of about 33 percent (about one third) of the axial length 129 of the chamber 121. The same holds for the length of the first axial portion 131. In contrast, the length of the third axial portion 133 is slightly shorter than the lengths of the first and second axial portions 131, 132.

The first axial portion 131 comprises a plurality of first protrusions 141 which extend from a base level area 145 of the first axial portion 131 in a direction towards the center axis 122 beyond a base level area 146 of the second axial portion 132. Likewise, the third axial portion 133 comprises a plurality of second protrusions 143 which extend from a base level area 147 of the third axial portion 133 in a direction towards the center axis 122 beyond the base level area 146 of the second axial portion 132. In contrast to the first and the third axial portions 131, 133, the second axial portion 132 does not comprise any protrusions. Instead, the second axial portion 132 is dimpled comprising a plurality of indentations 142 which extend from the base level area 146 of the second axial portion 132 outwards in a direction away from the center axis 122.

Hence, when an article 200 is inserted into the chamber 121, the article 200 is only in contact with the plurality of first protrusions 141 and the plurality of second protrusions 143. In contrast, the article 200 is not in contact with the second axial portion 132 of the inner surface 130. As a result, the overall contact area between the article 200 and the inner surface 130 of the chamber 121 is significantly reduced. Advantageously, this leads to an overall reduction of heat losses due to direct thermal conduction from the aerosol-generating article 200 to the inner surface 130. Furthermore, adverse moistening effects on the article 200 due to condensate formation in the chamber 121 are reduced as well. In addition, the reduced contact surface area makes insertion and removal of the article 200 easier, as the reduced contact surface area reduces the frictional forces to be overcome when moving an article 200 into or out of the chamber 121.

Notwithstanding the reduced contact area between the article 200 and the inner surface 130, the article 200 is still securely retained in the chamber 121 by the first and second protrusions 131, 132. In the present embodiment, this applies all the more as the arrangement and the dimensions of the first, second and third axial portions 131, 132, 133 are adapted to the arrangement and the dimensions of the proximal support element 230, the substrate element 220 and the distal support element 210. As can be seen in FIG. 1, when the article 200 is received in the chamber 121, the proximal support element 230 is in contact with the first protrusions 141 of the first axial portion 131 and the distal support element 210 is in contact with the second protrusions 143 of the third axial portion 133. In contrast, the substrate element 220 substantially is surrounded by the second axial portion 132, however, without any contact thereto. Only at its very axial ends, the substrate element 220 is partially in contact with the first protrusions 141 of the first axial portion 131 and the second protrusions 143 of the third axial portion 133. However it will be appreciated that in alternative embodiments, even the very axial ends may not be in contact with the protrusions 141, 143 or the first and third axial portions 131, 133 and instead the entire substrate element 220 may be within the second axial portion 132. Due to these specific configurations, the first and second protrusions 141, 143 of the first and the second axial portion 131, 133 substantially only engage with those portions of the article 200 which are most rigid and which tend to shrink least during use.

Furthermore, with reference to FIG. 1, the free space in between the first and the second protrusions 141, 143 forms a multi-dimensional matrix of airflow passages allowing air to flow between inner surface 130 of the chamber 121 and the outer surface of an aerosol-generating article 200 inserted in the chamber 121. Hence, when a negative pressure is applied at the filter element 250 of the aerosol-generating article 200 received in the receiving chamber 121, for example, when a user takes a puff, air is drawn into the receiving chamber 121 at the rim of the insertion opening 126, at the proximal end 101 of the device 100 or the proximal end 124 of the chamber 121, respectively. This airflow further passes along the inner surface 130 along the multi-channel airflow passages into the bottom portion at the distal end 123 of the receiving chamber 121. There, the airflow enters the aerosol-generating article 200 through the distal support element 210 and further passes through the substrate element 220, the proximal support element 230, the aerosol cooling element 240 and the filter element 250 where it finally exits the article 200. In the substrate element 240, vaporized material from the aerosol-forming substrate is entrained into the airflow and subsequently cooled down on its further way through the proximal support element 230, the aerosol cooling element 240 and the filter element 250 such as to form an aerosol. In order to enable a proper redirection of the airflow into the aerosol-generating article 200 at the distal end 123 of the receiving chamber 121, the aerosol-generating device 100 according to the present embodiment comprises end stops 128 which are arranged at the distal end 123 of the receiving chamber 121. The end stops 128 are configured to limit the insertion depth of the article 200 into the receiving chamber 121 and, thus, to prevent the article 200 from abutting the bottom surface of the receiving chamber 121. This is shown in FIG. 1.

With respect to the airflow passing along the inner surface 130 from the proximal end 124 of the chamber 121 towards the distal end 123 of the chamber 121, the plurality of indentations 142 in the second axial portion 132 causes the airflow along the second axial portion 132 to be turbulent. Advantageously, the turbulent airflow improves the airflow management through the device 100 and in particular ensures a sufficient heat exchange between air flowing around the article. Furthermore, the dimples 142 of the second axial portion 132 advantageously promote turbulent airflow in the region of the second axial portion 132, which helps to provide improved aerosol characteristics compared to conventional aerosol-generating systems In the present embodiment, the first and the second protrusions 141, 143 are formed as punctiform protrusions having a pimple-shape. The first and the second protrusions 141, 143 are arranged in a regular matrix pattern. In contrast, the plurality of indentations 142 have a cylindrical shape with a hexagonal cross-section. That is, the opening area of each indentation 142 has a hexagonal shape or hexagonal cross-section. The indentations 142 are arranged in a hexagonal pattern, in particular a honeycomb configuration. Accordingly, the base level area 146 of the second axial portion 132 has a hexagonal grid pattern, in particular a honeycomb pattern.

Both, the base level areas of the first and third axial portions 131, 133 and the base level area of the second axial portion are coherent areas having no isolated sections.

As can be in particular seen in FIG. 4, the first and the second protrusions 141, 143 have the same height dimension 148. Likewise, all indentations 142 have the same depth dimension 149. With regard to a good airflow management, the height dimension 148 preferably is in a range between 0.5 millimeter and 2 millimeter, in particular in a range of 0.75 millimeter and 1.5 millimeter, as measured in a radial direction towards the center axis 122. Likewise, the indentations 142 preferably have a depth dimension 149 in a direction normal to the opening area of the respective indentation in a range between 0.25 millimeter and 2 millimeter, preferably in a range between 0.5 millimeter and 1 millimeter.

The formation of a turbulent airflow can also be influenced by the density of the indentations 147. Preferably, a density of the plurality of indentations 147 is in a range between 0.1 and 1.0 indentations per square millimeter, preferably between 0.2 and 0.7 indentations per square millimeter. Likewise, a density of the plurality of first protrusions and second protrusions 141, 143 is in a range between 0.25 and 1.5 protrusions per square millimeter, in particular between 0.5 to 0.75 protrusions per square millimeter. As used herein, the density per square millimeter is referenced to the area content of the projection of the respective axial portion 131, 132, 133 onto its base level area in direction normal to the base level area, that is, to an envelope surface tangent to each point of the respective base level area 145, 146, 147 as indicated in FIG. 4 by the dashed lines 191, 192. In the present embodiment, the density of the plurality of first protrusions 141 and the density of the plurality of second protrusions 143 are identical, but lower than the density of the plurality of indentations 147.

FIG. 5 and FIG. 6 schematically illustrate a respective section of alternative embodiments of the first and third axial portion of inner surface 231, 233, 331, 333. In FIG. 5, the first and the second protrusions 241, 243 have a cuboid-shape and arranged in a regular square pattern. Accordingly, the respective base level areas 245, 247 has regular square grid pattern. In FIG. 6, the first and the second protrusions 341, 343 have a pyramidal shape. The respective base level areas 345, 347 have a crisscross grid pattern such as to provide linear airflow passages between the first and second protrusions 341, 343, respectively.

FIG. 7 shows an alternative embodiment of the second axial portion 432. Here, the second axial portion 432 comprises plurality of indentations 442 each of which has a partially spherical shape, with a circular cross-section. That is, the opening area of each indentation 442 has a circular shape or circular cross-section. The indentations 442 are arranged in a square grid pattern.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±5 percent of A.

The invention claimed is:

1. Aerosol-generating device for use with an aerosol-generating article, the aerosol-generating device comprising a chamber for removably receiving at least a portion of the aerosol-generating article, wherein along a center axis of the chamber, an inner surface of the chamber comprises a first axial portion and a second axial portion, wherein the first axial portion is closer to a proximal end of the chamber than the second axial portion, wherein the second axial portion is dimpled comprising a plurality of indentations, wherein the plurality of indentations are punctiform and extend from a base level area of the second axial portion outwards in a direction away from the center axis, and wherein the first axial portion comprises a plurality of first protrusions, wherein the plurality of first protrusions are configured to contact at least a portion of the aerosol-generating article received in the chamber, and wherein the plurality of first protrusions extend from a base level area of the first axial portion in a direction towards the center axis beyond the base level area of the second axial portion.

2. Aerosol-generating device according to claim 1, wherein at least one of the plurality of indentations has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape.

3. Aerosol-generating device according to claim 1, wherein an opening area of at least one of the plurality of indentations has a circular shape or an oval shape or an elliptical shape or a rectangular shape or a quadric shape or a rhombus shape or a parallelogram shape or triangular shape or a hexagonal shape or polygonal shape.

4. Aerosol-generating device according to claim 1, wherein a density of the plurality of indentations is in a range between 0.1 and 1.0 indentations per square millimeter.

5. Aerosol-generating device according to claim 1, wherein at least one of the plurality of indentations has a depth dimension in a direction normal to an opening area of the respective indentation in a range between 0.25 millimeter and 2 millimeter.

6. Aerosol-generating device according to claim 1, wherein the base level area of the second axial portion has a hexagonal grid pattern.

7. Aerosol-generating device according to claim 1, wherein the second axial portion has a length of at least 20 percent of an overall length of the inner surface or the chamber in the direction of the center axis.

8. Aerosol-generating device according to claim 1, wherein a density of the plurality of indentations is in a range between 0.2 and 0.7 indentations per square millimeter.

9. Aerosol-generating device according to claim 1, wherein at least one of the plurality of indentations has a depth dimension in a direction normal to an opening area of the respective indentation in a range between 0.5 millimeter and 1 millimeter.

10. Aerosol-generating device according to claim 1, wherein, along the center axis of the chamber, the inner surface of the chamber comprises a third axial portion, wherein the third axial portion is closer to a distal end of the chamber than the second axial portion, wherein the third axial portion comprises a plurality of second protrusions, wherein the plurality of second protrusions are configured to contact at least a portion of the aerosol-generating article received in the chamber, wherein the plurality of second protrusions extend from a base level area of the third axial portion in a direction towards the center axis, beyond the base level area of the second axial portion.

11. Aerosol-generating device according to claim 10, wherein each one of the base level area of the second axial portion, the base level area of the first axial portion and the base level area of the third axial portion is a coherent area.

12. Aerosol-generating device according to claim 10, wherein at least one of the base level area of the first axial portion and the base level area of the optional third axial portion has a crisscross grid pattern.

13. Aerosol-generating device according to claim 10, wherein at least one, or each one of the plurality of first protrusions has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape; or wherein at least one, or each one of the optional plurality of second protrusions has a conical shape or a frusto-conical shape or a pyramidal shape or a pimple-shape or a frusto-pyramidal shape or a dome-shape or a cuboid-shape or a partially spherical shape or a cylindrical shape or a trihedral shape or a polyhedral shape.

14. Aerosol-generating device according to claim 10, wherein at least one of a density of the plurality of first protrusions and a density of the optional plurality of second protrusions is in a range between 0.25 and 1.5 protrusions per square millimeter.

15. Aerosol-generating device according to claim 10, wherein at least one, or each one of the plurality of first protrusions has a height dimension in a range between 0.5 millimeter and 2 millimeter, or at least one, or each one of the plurality of second protrusions has a height dimension in a range between 0.5 millimeter and 2 millimeter.

16. Aerosol-generating device according to claim 10, wherein at least one of a density of the plurality of first protrusions and a density of the optional plurality of second protrusions is in a range between 0.5 to 0.75 protrusions per square millimeter.

17. Aerosol-generating device according to claim 10, wherein at least one, or each one of the plurality of first protrusions has a height dimension in a range between 0.75 millimeter and 1.5 millimeter; or at least one, or each one of the plurality of second protrusions has a height dimension in a range between 0.75 millimeter and 1.5 millimeter.

18. Aerosol-generating device according to claim 10, wherein at least one, or each one of the plurality of first protrusions has a height dimension in a range between 0.75 millimeter and 1.5 millimeter; and at least one, or each one of the plurality of second protrusions has a height dimension in a range between 0.75 millimeter and 1.5 millimeter.

19. An aerosol-generating system comprising the aerosol-generating device according to claim 10 and an aerosol-generating article comprising an aerosol-forming substrate, wherein at least a portion of the aerosol-generating article is removably received or removably receivable in the chamber of the aerosol-generating device.

20. The aerosol-generating system according to claim 19, wherein the aerosol-generating article comprises at least a proximal support element, and optional distal support element and a substrate element comprising the aerosol-forming substrate, the substrate element being located downstream the proximal support element and upstream the optional distal support element with regard to an airflow passing through the article in use of the system, wherein upon receiving the article in the chamber the proximal support element is in contact with the first axial portion, the optional third axial portion is in contact with the optional distal support element, and the substrate element is surrounded by the second axial portion without being in contact with the second axial portion.

* * * * *